US006151781A

United States Patent [19]

Dehler

[11] Patent Number: 6,151,781

[45] Date of Patent: Nov. 28, 2000

[54] METHOD AND APPARATUS FOR CUTTING A CIGARETTE

[76] Inventor: Blake A. Dehler, Briarwood Apartments, Apt. G1, Bricktop Rd., Windham, Conn. 06280

[21] Appl. No.: 09/368,995

[22] Filed: Aug. 5, 1999

[51] Int. Cl.[7] ..... A24F 13/24

[52] U.S. Cl. ..... 30/111; 30/113; 131/248; 431/253

[58] Field of Search ..... 30/109–113, 249, 30/241; 131/248–252; 431/253

[56] References Cited

U.S. PATENT DOCUMENTS

| | | | |
|---|---|---|---|
| 317,980 | 5/1885 | Dixon | 30/113 X |
| 1,098,107 | 3/1914 | Blood | 30/111 |
| 1,757,607 | 5/1930 | Zullo . | |
| 2,041,386 | 5/1936 | Van Laanen | 30/241 |
| 4,600,022 | 7/1986 | Pierce, Jr. . | |
| 4,642,827 | 2/1987 | Karuzas . | |
| 4,897,033 | 1/1990 | Yang . | |
| 5,738,117 | 4/1998 | Fontaine, Jr. . | |
| 5,791,051 | 8/1998 | Schmidt . | |
| 5,888,061 | 3/1999 | Reynolds . | |
| 5,913,676 | 6/1999 | Kim | 131/249 X |

FOREIGN PATENT DOCUMENTS

| | | |
|---|---|---|
| 383836 | 10/1923 | Germany . |
| 625949 | 2/1936 | Germany . |
| 696344 | 9/1940 | Germany . |

*Primary Examiner*—Douglas D. Watts
*Attorney, Agent, or Firm*—McCormick, Paulding & Huber LLP

[57] ABSTRACT

A hollow cutter body having an opening is adapted to slidably receive an end of a cigarette lighter. The opening is defined by a cutter body wall that has a slot extending from an end of the cutter body opposite to the opening, and at least partway along a length defined by the cutter body. An aperture is also defined by the cutter body opposite and approximately aligned with the slot and includes a sharpened peripheral edge, against which a cigarette can be trimmed. The cigarette is trimmed by sliding an end through the aperture and the slot and actuating the cutter body by moving it along the lighter, causing an end of the cigarette to be cut.

5 Claims, 1 Drawing Sheet

METHOD AND APPARATUS FOR CUTTING A CIGARETTE

FIELD OF THE INVENTION

The present invention relates generally to smoking accessories, and more specifically to an apparatus adaptable for use with a cigarette lighter to trim the lit end from a cigarette thereby allowing the remainder of the cigarette to be smoked at a later time.

BACKGROUND OF THE INVENTION

The present invention is useful for trimming an end from tobacco products and finds particular utility in trimming the lit end from a cigarette. Accordingly, the present invention will be described herein as being directed to such use, however, this should not be a limitation.

Smokers often only partially consume a cigarette, discarding substantial unsmoked portions. This is due to various different reasons, for example, during a work break there may be insufficient time available to the person to completely smoke the cigarette. Over time, discarding the unsmoked portions of the cigarettes results in the waste of substantial amounts of money as cigarettes can be quite expensive.

In order to preserve the unsmoked portion of the cigarette for future consumption, the lit end of the cigarette must be removed. This can be done by either cutting the lit end, or manually tearing it from the cigarette.

Existing tools for cutting the lit end of cigarettes are often combined with cigarette lighters. However, these combination cigarette lighter and cutters tend to be expensive and are not the type that would be carried on a daily basis for casual use. In addition, the cutter portion of these lighters can include scissors or other external sharp edges which, when reached for in a user's pocket, can result in injury. These sharp edges can also damage the user's clothing, such as a shirt or pants pocket. Furthermore, some existing cigarette cutters tend to be difficult to use, requiring two hands to manipulate the cutter, thereby making it practically impossible to also hold the lit cigarette being cut.

Based on the foregoing, it is the general object of the present invention to provide a cutter that overcomes the difficulties and drawbacks associated with prior art cutters.

It is a more specific object of the present invention to provide a cigarette cutter adaptable for use with a disposable lighter.

SUMMARY OF THE INVENTION

The present invention is directed to an apparatus for cutting a cigarette adaptable for use with a cigarette tighter, comprising a hollow cutter body having an opening defined by a cutter wall adapted to slidably receive an end of the cigarette lighter. The cutter body wall includes a slot extending from an end of the cutter body opposite to said opening, and at least partway along a length defined by the cutter body. An aperture is defined by the cutter body opposite and approximately aligned with said slot, with the aperture being defined by a sharpened peripheral edge. A cigarette can be trimmed by sliding an end of the cigarette through the aperture and the slot and sliding the cutter body along the lighter, causing the cigarette to be cut by the sharpened edge.

A method for employing the above-described present invention comprises sliding an end of a cigarette through the slot and the aperture and sliding the cutter body along the cigarette lighter, causing the cigarette to be cut by the sharpened edge.

DETAILED DESCRIPTION OF THE PREFERRED EMBODIMENTS

Figure 1:
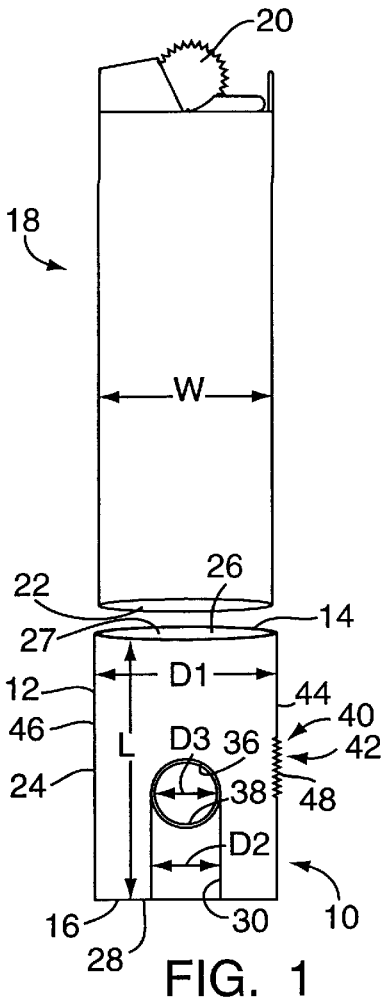
FIG. 1 is an exploded front view of a cigarette cutter in accordance with the present invention and a cigarette lighter on which the cutter can be slidably mounted.

FIG. 1 illustrates a cigarette cutter 10 according to the present invention that includes a hollow cutter body 12 having a first end 14 and a second end 16. The cutter body 12 is preferably made of plastic, but may be made of other suitable materials, such as, but not limited to, steel, aluminum or tin. In the illustrated embodiment of the present invention, the cigarette lighter 18 is shown as having an oval-shaped peripheral surface, and with the cutter body 12 having a cutter body wall 24 broadly defining in the first end 14 an opening 26 of a shape complementary to the shape of the peripheral surface of the cigarette lighter. However, the present invention is not limited in this regard as the opening 26 can be made to conform to the shape of any lighter peripheral surface without departing from the broader aspects of the present invention.

The cutter body 12 includes an interior area 27 defined by the cutter body wall 24. The interior area 27 is accessible via the opening 26 in the first end 14 of the cutter body and is adapted to slidably receive a top 20 and a base 22 of the cigarette lighter 18. However, the present invention is not limited in this regard as the base 22 and the top 20 of the cigarette lighter 18 may not have the same shape or size, in which case the interior area 27 may be adapted to receive only the base 22 or the top 20 without departing from the broader aspects of the present invention.

The cutter body wall 24 defines an opening 28 in the second end 16 of the cutter body 12 which is adapted to slidably receive the top 20 and base 22 of the cigarette lighter 18. However, the present invention is not limited in this regard as the base 22 and the top 20 of the cigarette lighter 18 may not have the same shape or size, in which case the opening 28 may be adapted to receive only the base 22 or the top 20. Alternatively, the second end 16 may be closed or partially closed, without departing from the broader aspects of the present invention.

Still referring to FIG. 1, the cutter body wall 24 defines a slot 30 that extends from the second end 16 of the cutter body 12 opposite the opening 26 at least partway along a length L defined by the cutter body. While a slot 30 extending partway along the length L of the cutter body 12 has been shown, the present invention is not limited in this regard as the slot may extend the entire length L of the cutter body. Preferably the slot 30 has a width D2 which is slightly larger than the diameter d of a cigarette 32 and the slot has an end which is U shaped so that the cigarette may be easily inserted. However, the present invention is not limited in this regard as the end of the slot may be square or any other shape which accommodates the insertion and removal of a cigarette.

Figure 2:
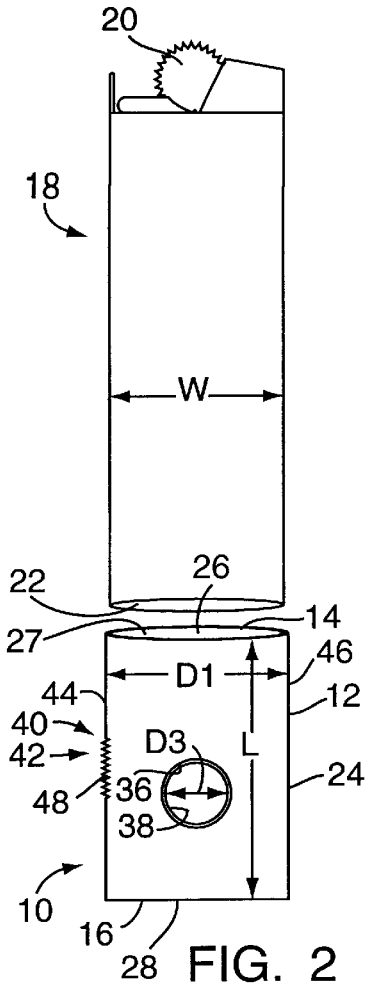
FIG. 2 is an exploded rear view of the cigarette cutter and the cigarette lighter of FIG. 1.

Referring to FIG. 2, the cutter body 12 defines an aperture 36 opposite and approximately aligned with the slot 30. The diameter D3 of the aperture 36 is slightly larger than the diameter d of a cigarette 32 so that a cigarette may be easily inserted therethrough. The aperture 36 is defined by a peripheral edge 38 at least a portion of which is sharpened for cutting an end 34 from the cigarette 32. In the preferred embodiment, the peripheral edge 38 may be a sharpened beveled edge, but the present invention is not limited in this regard as other methods of sharpening the peripheral edge, such as mounting a sharpened ring to the peripheral edge, can be substituted without departing from the broader aspects of the present invention. Since the cutting edge of the cigarette cutter is located within the cutter body, it is not likely to cut or snag a pocket or purse while the cigarette cutter is being stored.

Figure 3:
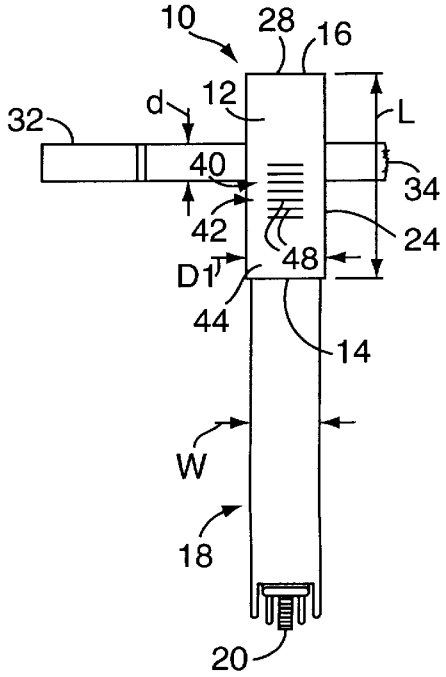
FIG. 3 is a side view of the cigarette cutter of FIG. 1 shown slidably ounted on the cigarette lighter and with a cigarette positioned for cutting.

FIGS. 2 and 3 illustrate the cutter body 12 having a gripping means 40 for easily grasping and slidably moving the cutter body relative to the cigarette lighter 18. In the preferred embodiment the gripping means is a thumb grip 42 located on either a first or second side 44, 46 of the cutter body 12. The thumb grip 42 is defined as a plurality of approximately parallel grooves 48 extending into the cutter body 12. While a thumb grip has been shown and described, the present invention is not limited in this regard as other means to facilitate gripping the cutter body, such as coating the cutter body with an abrasive surface, or attaching a piece of cloth or rubber to the cutter body, can be substituted without departing from the broader aspects of the present invention.

Referring to FIG. 3, in operation, the cigarette cutter 10 may be operated with one hand while holding the cigarette 32 with the other hand. This is accomplished by first inserting the top 20 of the cigarette lighter 18 into the opening 28 in the second end 16 of the cutter body 12. The next step begins by sliding the cutter body 12 to the base 22 of the cigarette lighter 18 by grasping the thumb grip 42 of the cutter body. Continue sliding the cutter body 12 until the aperture 36 is clear of the base 22 of the cigarette lighter 18. The next step is accomplished by sliding the end 34 of a cigarette 32 into the slot 30 and into the aperture 36 until the end of the cigarette extends beyond the aperture.

Reversing direction, slide the cutter body 12 on the cigarette lighter 18 by grasping the thumb grip 42, causing the base 22 of the cigarette lighter to press against an unlit section of the cigarette 32. The base 22 of the cigarette lighter 18 applies pressure to the cigarette 32 and presses the cigarette against the sharpened peripheral edge 38 of the aperture 36, thereby causing the cigarette 32 to be cut by the sharpened edge 38, and removing the end 34 of the cigarette. The remaining unused section of the cigarette 32 may be removed from the cutter body 12 and saved.

Alternatively, still referring to FIG. 3, a cigarette 32 may be trimmed by sliding the base 22 of the cigarette lighter 18 into the opening 26 in the first end 14 of the cutter body 12. Once the cigarette lighter 18 has been partially slid into the cutter body 12, continue sliding the cutter body partially onto the cigarette lighter by grasping the thumb grip 42, and verify that the aperture 36 is not obstructed by the cigarette lighter. Continue by sliding the end 34 of the cigarette 18 into the slot 30 and into the aperture 36 until the end of the cigarette extends beyond the aperture.

Continuing to slide the cutter body 12 on the cigarette lighter 18 by grasping the thumb grip 42 presses the base 22 of the cigarette lighter against an unlit section of the cigarette 32. The base 22 of the cigarette lighter 18 applies pressure to the cigarette 32 and presses the cigarette against the sharpened peripheral edge 38 of the aperture 36, thereby causing the cigarette 32 to be cut by the sharpened edge 38, and removing the end 34 of the cigarette. The remaining unused section of the cigarette 32 is removed from the cutter body 12 and saved. For this alternative method of operation, the second end 16 of the cutter body 12 may be open, closed or partially closed.

Alternatively, as shown in FIG. 3, once the cutter body 12 is positioned for cutting on the cigarette lighter 18, and the cigarette 32 has been slidably inserted, the cigarette cutter 10 may be operated by holding the second end 16 of the cutter body against any hard surface, such as a table surface, and pushing the cigarette lighter towards the table surface causing the cigarette 32 to be cut by the sharpened edge 38. For this alternative method of operation, the second end 16 of the cutter body 12 may be open, closed or partially closed.

While a cigarette cutter for use with a disposable cigarette lighter has been shown and described, the present invention is not limited in this regard as other designs for cigarette lighters, such as square, oblong, or cigarette lighters which have varying widths, and other types of lighters, such as refillable lighters, can be substituted without departing from the broader aspects of the present invention.

What is claimed is:

1. An apparatus for cutting a cigarette adaptable for use with a cigarette lighter, comprising:

a hollow cutter body having an opening defined by a cutter body wall and adapted to slidably receive an end of a cigarette lighter;

said cutter body wall including a slot extending from an end of said cutter body opposite to said opening, and at least partway along a length defined by said cutter body;

an aperture defined by said cutter body opposite and approximately aligned with said slot; and said aperture being defined by a sharpened peripheral edge, such that a cigarette can be trimmed by sliding an end of said cigarette through said aperture and said slot and sliding said cutter body along said lighter causing said cigarette to be cut by said sharpened edge.

2. An apparatus for cutting as defined by claim 1, wherein said cutter body further includes gripping means for slidably moving said cutter body relative to said lighter.

3. An apparatus for cutting as defined by claim 2, wherein said gripping means includes a plurality of approximately parallel grooves defined by said cutter body.

4. An apparatus for cutting as defined by claim 1, wherein said peripheral edge is beveled.

5. A method for cutting a cigarette employing a cigarette cutter adaptable for use with a cigarette lighter, comprising the steps of:

providing a hollow cutter body having an opening defined by a cutter body wall and adapted to slidably receive an end of a cigarette lighter, said cutter body wall including a slot extending from an end of said cutter body opposite to said opening, and at least partway along a length defined by said cutter body, and an aperture defined by a sharpened peripheral edge of said cutter body opposite and approximately aligned with said slot;

sliding an end of a cigarette through said aperture and said slot; and sliding said cutter body along the cigarette lighter causing the cigarette to be cut by said sharpened edge.

* * * * *

UNITED STATES PATENT AND TRADEMARK OFFICE

CERTIFICATE OF CORRECTION

PATENT NO. : 6,151,781

DATED : November 28, 2000

INVENTOR(S) : Blake A. Dehler

It is certified that error appears in the above-identified patent and that said Letters Patent is hereby corrected as shown below:

Column 1, Line 51: After "with a cigarette", delete "tighter" and substitute --lighter--.

In the Brief Description of the Drawings:

Column 2, Line 9: After "slidably", delete "ounted" and substitute --mounted--.

Signed and Sealed this

Eighth Day of May, 2001

*Attest:*

Nicholas P. Godici

NICHOLAS P. GODICI

*Attesting Officer*

*Acting Director of the United States Patent and Trademark Office*